US005344376A

United States Patent [19]

Bostic et al.

[11] Patent Number: 5,344,376

[45] Date of Patent: Sep. 6, 1994

[54] EXERCISE APPARATUS WITH TURNTABLE AND PIVOTING POLES

[75] Inventors: James R. Bostic, Watertown; John S. Dreibelbis, Shakopee; Pat J. Novak, St. Paul, all of Minn.

[73] Assignee: NordicTrack, Inc., Chaska, Minn.

[21] Appl. No.: 936,082

[22] Filed: Aug. 26, 1992

[51] Int. Cl.[5] ..... A63B 21/015

[52] U.S. Cl. ..... 482/118; 482/114; 482/147

[58] Field of Search ..... 482/114, 115, 118, 119, 482/146, 147, 62, 70, 71, 135-138

[56] References Cited

U.S. PATENT DOCUMENTS

| | | | |
|---|---|---|---|
| 1,975,382 | 10/1934 | Wrobley | 482/146 |
| 3,784,193 | 1/1974 | Simjian . | |
| 3,861,382 | 1/1975 | Simjian | 482/57 |
| 4,026,279 | 5/1977 | Simjian | 482/147 |
| 4,313,603 | 2/1982 | Simjian | 482/147 |
| 4,374,588 | 2/1983 | Ruggles | 482/118 |
| 4,618,139 | 10/1986 | Haaheim | 482/115 |
| 4,953,858 | 9/1990 | Zelli . | |
| 5,145,481 | 9/1992 | Friedebach | 482/118 |

OTHER PUBLICATIONS

Copy of p. 6 from sales sell sheet on Fitness Master LT-35.

Copy of sales sell sheet on Sierra Model, by Fitness Master.

Copy of page from self care catalog, printed in late spring 1992, showing No-Sweat Waist Trimmer.

*Primary Examiner*—Richard J. Apley

*Assistant Examiner*—Jeanne M. Mollo

[57] ABSTRACT

The present invention provides an exercise apparatus 100 having a turntable 120 rotatably mounted proximate one end of a base 110, and right and left poles 130 and 140 pivotally mounted proximate an opposite end of the base 110. A person stands on the turntable 120, swivels the hips to rotate the turntable 120, and reciprocally pushes and pulls the poles 130 and 140 against resistance provided by an adjustable resistance mechanism 150.

6 Claims, 5 Drawing Sheets

EXERCISE APPARATUS WITH TURNTABLE AND PIVOTING POLES

FIELD OF THE INVENTION

The present invention relates generally to exercise equipment and more particularly, to an exercise apparatus having a turntable on which a person may stand and swivel, and pivoting poles that a person may reciprocally push and pull, and a method of exercise involving same.

BACKGROUND OF THE INVENTION

More and more people are recognizing the benefits of regular exercise, and the exercise industry has experienced rapid growth as a result. Popularity has sparked demand for exercise equipment and translated into greater sophistication, increasing the need for new and improved exercise equipment that is fun, safe, easy, and effective in use. The present invention addresses this demand by providing an exercise apparatus that uniquely facilitates exercise of the upper and lower body.

SUMMARY OF THE INVENTION

According to one embodiment, the present invention provides an exercise apparatus having a turntable rotatably mounted proximate one end of a base, and right and left poles pivotally mounted proximate an opposite end of the base. A person stands on the turntable, swivels the hips to rotate the turntable, and reciprocally pushes and pulls the poles against resistance provided by a resistance means.

In a preferred embodiment, the poles extend from respective pivot ends to respective distal ends, and handle grips are secured to the distal ends. The pivot ends are relatively nearer to one another, and the distal ends are relatively farther from one another. The poles pivot relative to the base, as well as one another, subject to resistance provided by an adjustable resistance means. Also, the poles pivot to a collapsed position in which all portions of the exercise apparatus are within six inches of the floor surface. Additionally, each of the poles includes an upper segment and a lower segment releasably fastened relative to one another. The poles are longer than the base, but each lower segment is shorter than the base, so the upper segments can be removed to further collapse the apparatus for storage and/or transportation purposes.

The resistance means is incorporated into a pivot assembly secured relative to the base by right and left flanges extending upward from the front end of the base. Right and left brake pads are positioned between and adjacent respective right and left flanges, and the pivot ends of the right and left poles are positioned between the right and left brake pads. Outwardly facing bearing plates on the pivot ends are positioned adjacent respective brake pads, and a central brake pad is positioned between inwardly facing bearing plates on the pivot ends. The right and left flanges, the right and left brake pads, the pivot ends, and the central brake pad are secured relative to one another by a bolt that extends through holes in the assembly components and secured to a knob. The pivot ends are rotatable relative to one another and the opposing flanges, subject to frictional resistance provided by the brake pads. The resistance can be increased by tightening the knob relative to the bolt, and decreased by loosening the knob relative to the bolt.

The present invention also provides a method of exercising, in which a person stands on a turntable, facing frontward, and reaches forward and grasps a pivoting pole in each hand. The person swivels his or her hips to alternately rotate the turntable clockwise and counterclockwise, and reciprocally pushes and pulls the poles. In other words, the person alternately pushes the pole in the left hand while pulling the pole in the right hand, and pulls the pole in the left hand while pushing the pole in the right hand. According to the preferred method of exercising, the swiveling is done contemporaneously with the pushing and pulling. In this regard, the person may additionally selectively fasten a belt between the pole in the right hand and the pole in the left hand and engage the belt with his or her lower back and hips to help synchronize the swiveling and the pushing and pulling. As an additional step, the person may find it necessary and/or desirable to adjust resistance to pivoting of the pivoting poles.

The present invention provides an exercise apparatus that facilitates exercise of both the upper and lower body and yet, is relatively simple in construction. Also, the apparatus can be readily collapsed for storage and/or transportation. The method of exercise provides an effective workout that is fun and safe. These and other advantages of the present invention will become apparent upon a more detailed description of the preferred embodiment.

DETAILED DESCRIPTION OF A PREFERRED EMBODIMENT

Figure 1:
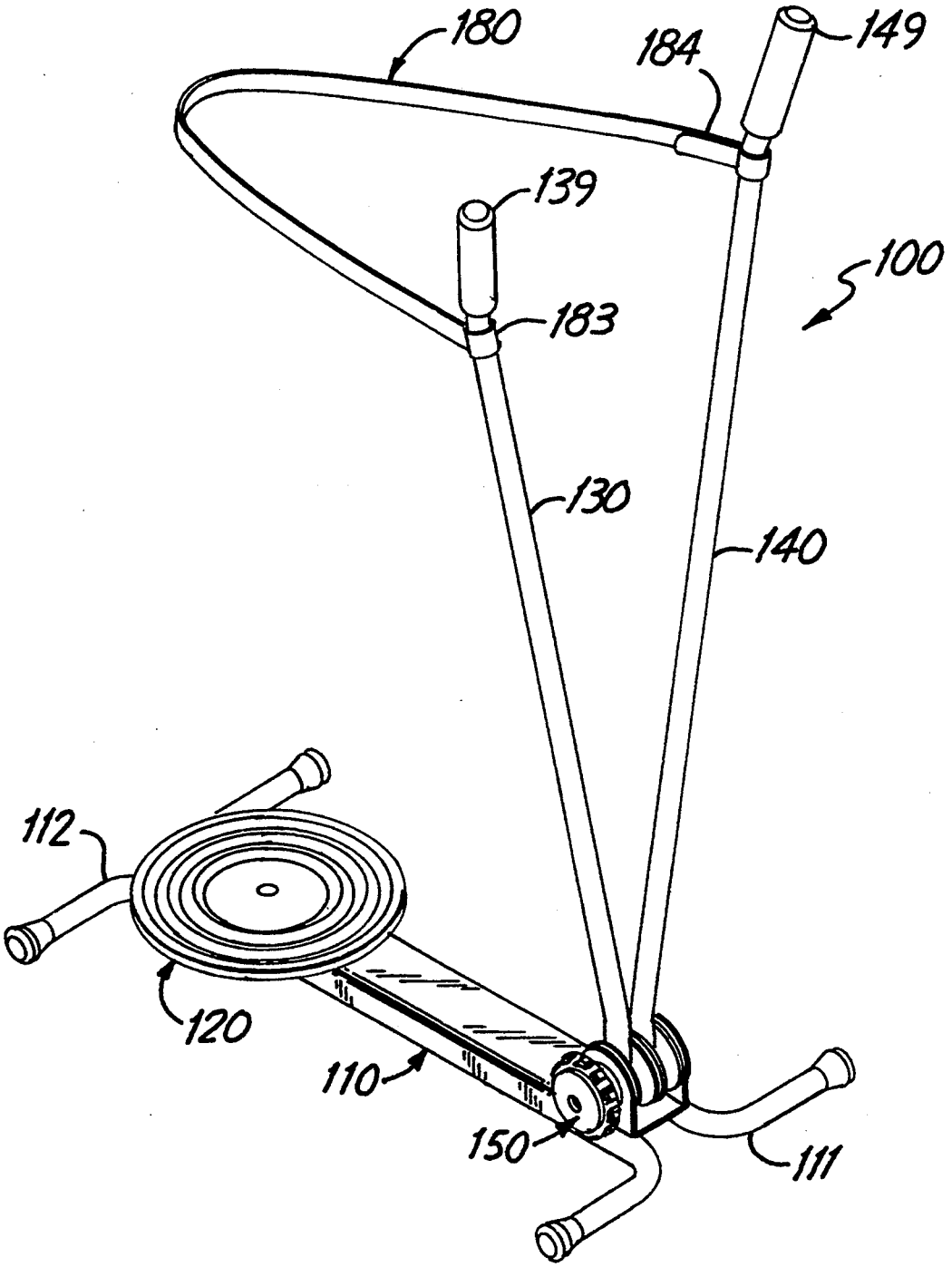
FIG. 1 is a perspective view of an exercise apparatus constructed according to the principles of the present invention.
Figure 2:
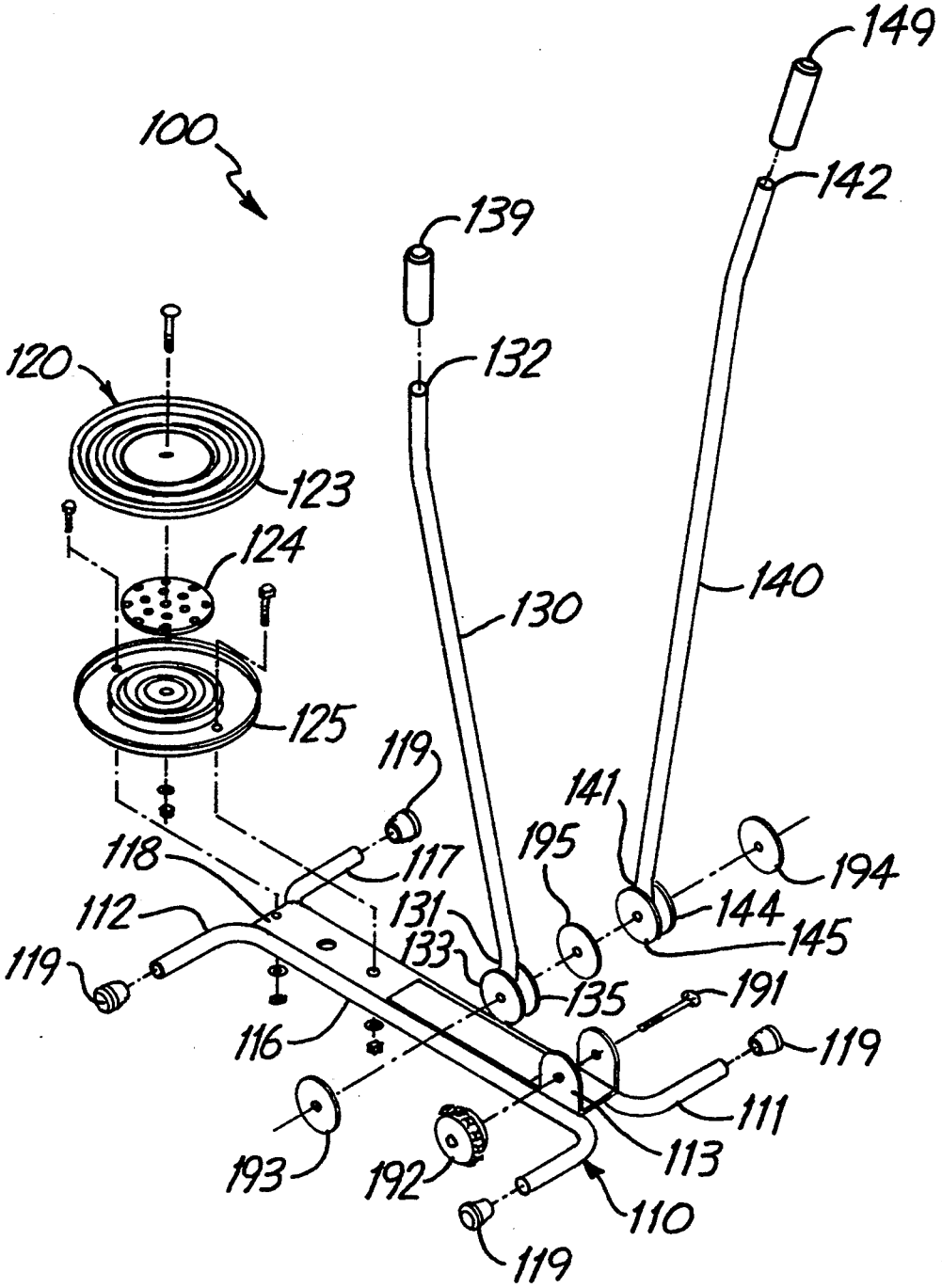
FIG. 2 is an exploded perspective view of the exercise apparatus shown in FIG. 1.
Figure 3:
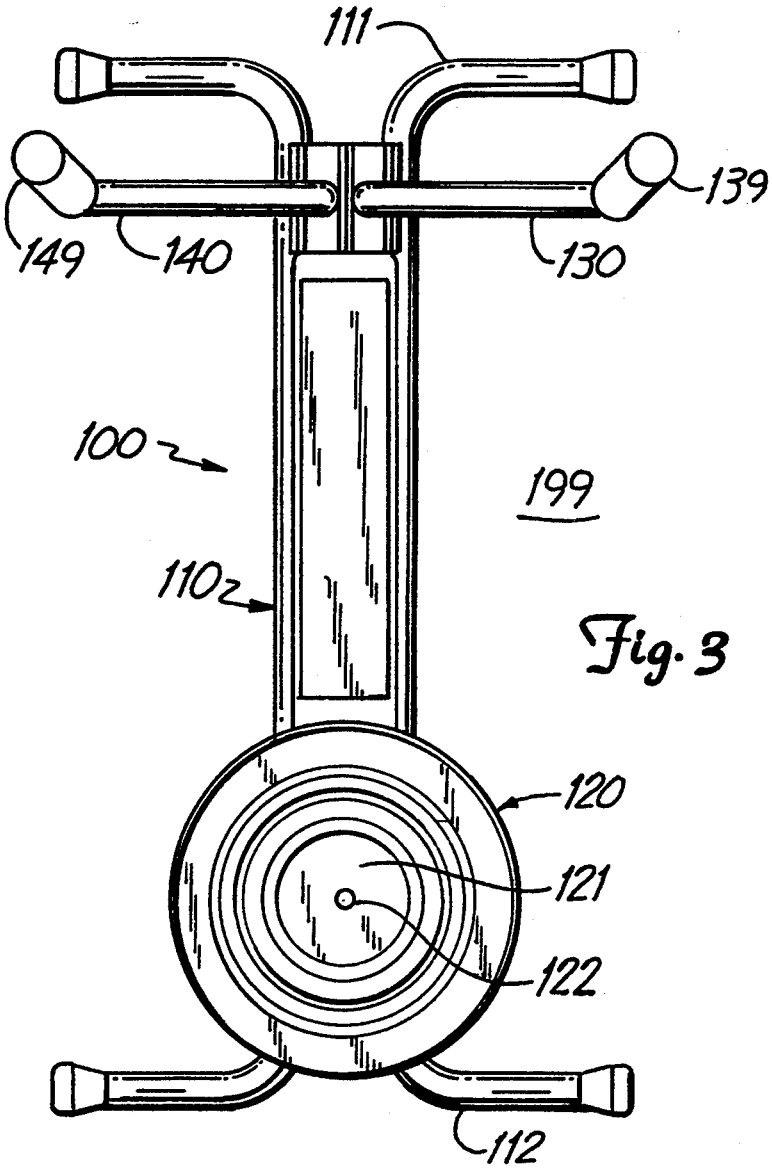
FIG. 3 is a top view of the exercise apparatus shown in FIG. 1.
Figure 4:
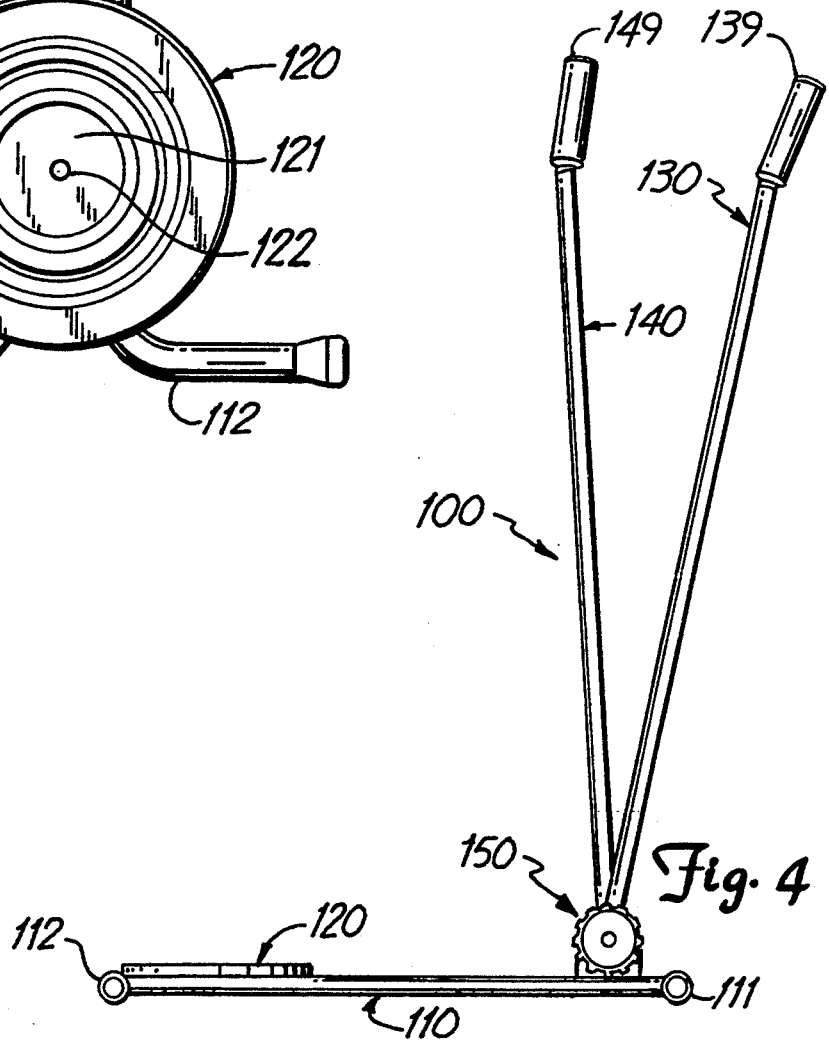
FIG. 4 is a side view of the exercise apparatus shown in FIG. 1.

With reference to the Figures, wherein like numerals represent like parts throughout the several views, an exercise apparatus constructed according to the principles of the present invention is designated at 100. The apparatus 100 generally includes a base 110, a turntable 120, first and second (right and left) poles 130 and 140, respectively, and a resistance means 150. A person stands on the turntable 120, swivels his or her hips to rotate the turntable 120, and reciprocally pushes and pulls the poles 130 and 140 against resistance provided by the resistance means 150.

The base 110 extends from a front end 111 to a rear end 112 and is designed to rest upon a floor surface 199. The base 110 includes left and right U-shaped tube members 116 and 117 secured along their length by welding to a central plate 118. The U-shaped members 116 and 117, as well as the poles 130 and 140, are made of one inch diameter steel tubing. The corresponding distal ends of the U-shaped members 116 and 117 face away from one another and are fitted with plastic caps 119. As such, the base 110 utilizes a relatively small amount of materials and occupies a relatively small amount of space in providing stability for operation of the apparatus 100.

The turntable 120 is rotatably mounted to the base 110 proximate the rear end 112. The turntable 120 has a load bearing surface (or platform) 121 that is substantially parallel to the floor surface 199 when the apparatus 100 is in an operable position. The turntable 120 includes a lower disk 125 that is secured to the base plate 118 by a nut and bolt combination. An upper disk 123 is rotatably secured relative to the lower disk 125 by another nut and bolt combination, with a bearing assembly 124 sandwiched therebetween. The construction is such that the upper disk 123, having the load bearing surface 121, is free to rotate relative to the lower disk 125 and the base 110. The upper disk 123 rotates about an axis 122 that is perpendicular to the floor surface 199 and located on the longitudinal axis of the base 110.

The turntable 120 can be modified to include various additional features. For example, a brake pad arrangement can be added to provide variable, two-way resistance to rotation of the turntable 120. Also, a spring return can be added to provide orienting, one-way resistance to rotation of the turntable 120. Alternatively, a stop mechanism can be added to abruptly limit the range of rotation of the turntable 120.

The first and second poles 130 and 140 extend from respective pivot ends 131 and 141 to respective distal ends 132 and 142. The pivot ends 131 and 141 are pivotally mounted to the base 110 proximate the front end 111, and the distal ends 132 and 142 are fitted with handle grips 139 and 149. The poles 130 and 140 diverge from their pivot ends 131 and 141 to their distal ends 132 and 142. In other words, the pivot ends 131 and 141 are relatively nearer to one another, and the distal ends 132 and 142 are relatively farther from one another. The configuration of the apparatus 100 is such that a person standing on the load bearing surface and facing frontward can reach forward and grasp one of the handle grips 139 and 149 in each hand. Alternatively, a person standing on the turntable 120 and facing rearward can reach backward and grasp one of the handle grips 139 and 149 in each hand.

The poles (or pivot arms) 130 and 140 pivot relative to the base 110 and one another, subject to resistance provided by the resistance means 150. The resistance means 150 is incorporated into a pivot assembly that is secured to the base 110 by right and left flanges 113 and 114, which extend upward from the front end 111 of the base 110. Right and left brake pads 193 and 194 are positioned between and adjacent respective right and left flanges 113 and 114, and the pivot ends 131 and 141 are positioned between the right and left brake pads 193 and 194. The inside surfaces of the flanges 113 and 114 function as frictional engagement surfaces relative to the brake pads 193 and 194. Outwardly facing bearing plates 133 and 144 on the respective pivot ends 131 and 141 are adjacent respective brake pads 193 and 194, and a central brake pad 195 is positioned between and adjacent inwardly facing bearing plates 135 and 145 on the respective pivot ends 131 and 141. In a preferred embodiment, the brake pads are made of leather, and the frictional engagement surfaces of the flanges 113 and 114 and the bearing plates 133, 135, 144, and 145 are raw, oil coated steel.

Holes are formed in the right and left flanges 113 and 114, the right and left brake pads 193 and 194, the pivot ends 131 and 141, and the central brake pad 195. The parts of the pivot assembly are aligned and secured relative to one another by a bolt 191 that extends though the holes, and a knob 192 that mates with the bolt 191. The pivot arms 130 and 140 rotate subject to frictional resistance between (1) the brake pads 193 and 194 and the flanges 113 and 114; (2) the brake pads 193 and 194 and the outwardly facing bearing plates 133 and 144; and (3) the brake pad 195 and the inwardly facing bearing plates 135 and 145. Those skilled in the art will recognize that tightening the knob 192 relative to the bolt 191 increases the frictional resistance, and loosening the knob 192 decreases the frictional resistance. Due to the divergence of the poles 130 and 140, the distal ends 132 and 142 are adequately separated for manual operation by a person standing on the turntable 120, and yet, the pivot ends 131 and 141 are secured in a single assembly, which is cost effective and assures balanced resistance to pivoting of the left and right poles 130 and 140.

Figure 5:
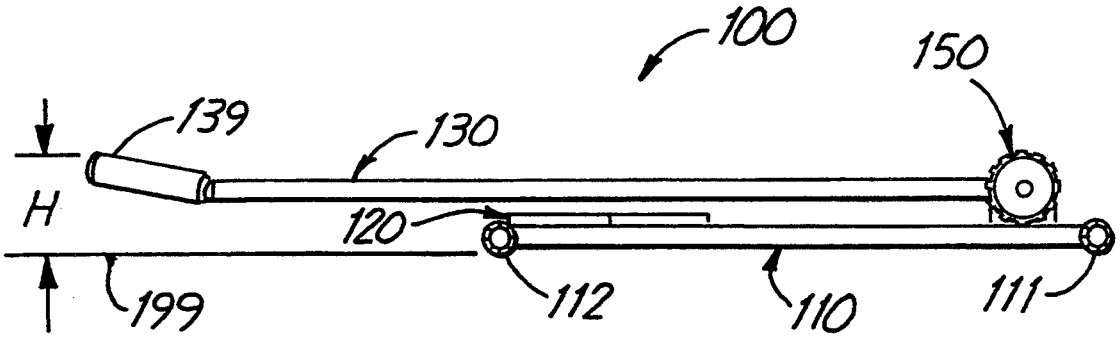
FIG. 5 is a side view of the exercise apparatus shown in FIG. 1, with the poles in a collapsed position.
Figure 6:
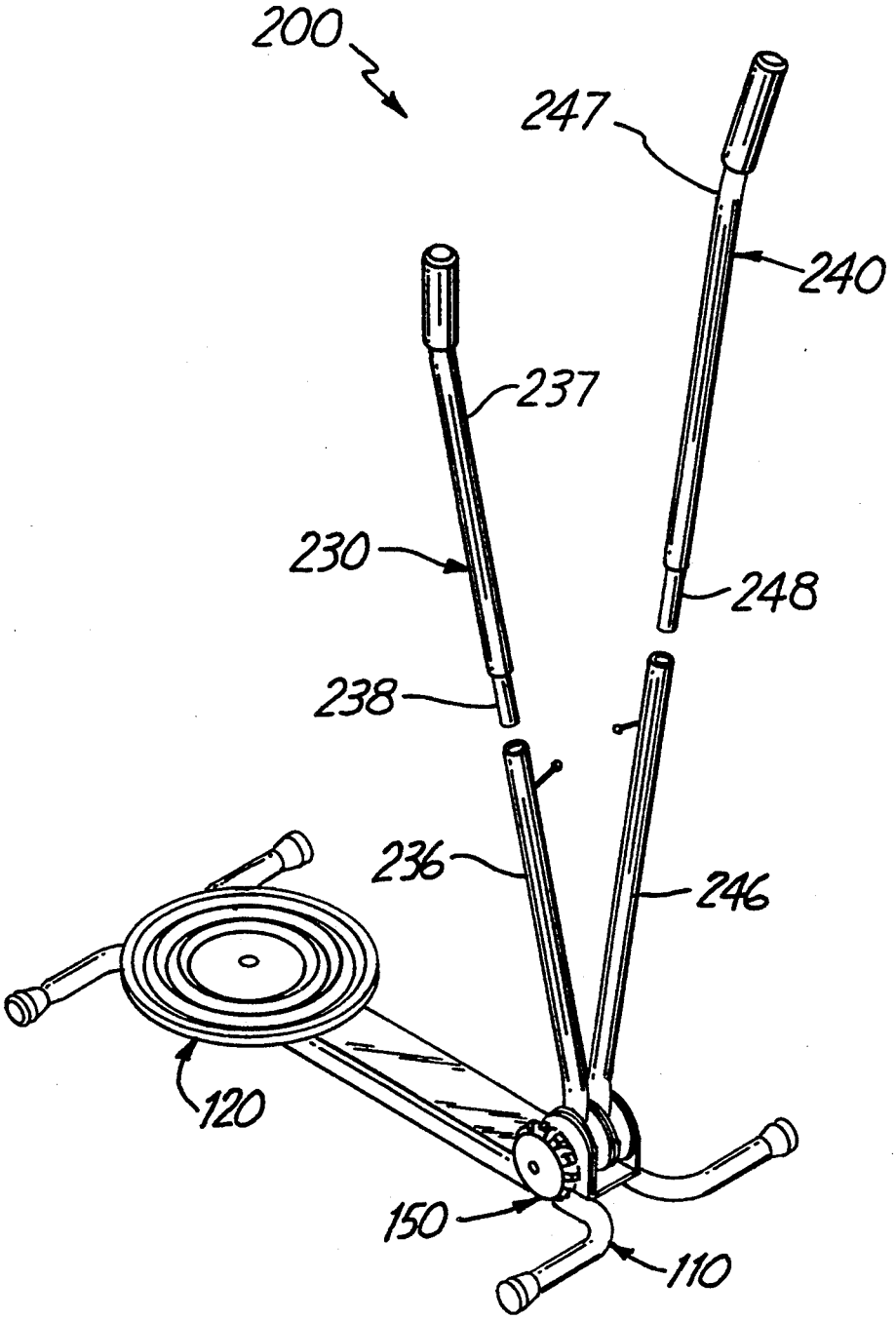
FIG. 6 is a perspective view of a preferred embodiment exercise apparatus constructed according to the principles of the present invention.

As shown in FIG. 5, the poles 130 and 140 pivot to a collapsed position in which they are substantially parallel to the base 110 and the floor surface 199. In the collapsed position, the exercise apparatus 100 has an overall height H, which is less than six (6) inches. In other words, all portions of the apparatus 100 shown in FIG. 5 are within six (6) inches of the floor surface 199. In the preferred embodiment 200 shown in FIG. 6, the poles 230 and 240 include upper segments 237 and 247 and lower segments 236 and 246, respectively. The respective tapered ends 238 and 248 on the upper segments 237 and 247 are inserted into the respective open ends on the lower segments 236 and 246, and releasably secured in place by set screws. The poles 230 and 240 are longer than the base 110, but the lower segments 236 and 246 are shorter than the base 110. Thus, the upper segments 237 and 247 can be removed to further collapse the apparatus 200 for storage and/or transportation purposes. In view of the slight bend near the distal ends of the poles, the removal of the upper segments also decreases the overall height of the collapsed apparatus to less than five (5) inches. The preferred embodiment 200 is similar in all other respects to the embodiment 100 shown in FIGS. 1–5.

To exercise on the apparatus 100, a person stands on the turntable 120, faces frontward, and reaches forward and grasps a pivoting pole (130 or 140) in each hand. In other words, the person faces toward the front end 111 of the base 110 and reaches out in front of his or her person to grasp the poles 130 and 140. Then, the person swivels his or her hips to alternately rotate the turntable 120 clockwise and counterclockwise and alternately pushes the pole in the left hand and pulls the pole in the right hand, and pulls the pole in the left hand and pushes the pole in the right hand. In other words, the person pushes and pulls the poles back and forth in a reciprocal fashion. Alternatively, a person can stand on the turntable 120, face toward the rear and 112 of the base 110, and reach behind his or her person to grasp a pole in each hand. Also, the person may find it necessary and/or desirable to set and/or adjust the resistance to pivoting of the poles 130 and 140.

In a preferred mode of operation, the swiveling is done contemporaneously with the pushing and pulling on the poles 130 and 140. In order to facilitate synchronous motion, a person may selectively fasten a belt 180 to the poles 130 and 140, as shown in FIG. 1. A first end 183 of the belt 180 is secured to the distal end 132 of the first pole 130, and a second end 184 of the belt 180 is secured to the distal end 142 of the second pole 140. The ends of the belt are releasably secured to the poles by hook and fastener combinations or by other means known in the art. The person standing on the turntable 120 presses his or her lower back and hips into engagement with the belt 180, which effectively links rotation of the turntable 120 with pivoting of the poles 130 and 140 to coordinate the swiveling motion with the pushing/pulling motion.

The present invention has been described with reference to a preferred embodiment. However, those skilled in the art will recognize a variety of alternative embodiments that fall within the scope of the present invention. Accordingly, the present invention is to be limited only by the appended claims.

We claim:

1. An exercise apparatus, comprising a base designed to rest upon a floor surface and extending from a front end to a rear end, a platform mounted to said base, right and left pivot arms extending between pivot ends mounted to said base and distal ends that can be grasped by a person standing on said platform, and a pivot assembly including right and left flanges secured to said base approximate said front end and extending upward from said floor surface, right and left brake pads positioned between said right and left flanges and adjacent respective flanges, with said pivot ends of said right and left pivot arms positioned between said right and left brake pads, and outwardly facing bearing plates on said pivot ends adjacent respective brake pads, and a single central brake pad positioned between inwardly facing bearing plates on said pivot ends, wherein said right and left flanges, said right and left brake pads, said pivot ends, and said central brake pad are secured relative to one another by a bolt extending through holes therein and a knob that mates with said bolt, and said pivot ends are rotatable relative to one another and said opposing flanges, subject to frictional resistance provided by said brake pads, whereby three brake pads engage four bearing plates and two flanges.

2. An exercise apparatus according to claim 1, wherein said platform is rotatable relative to said base.

3. An exercise apparatus according to claim 2, wherein said right and left pivot arms pivot independent of rotation of said platform.

4. An exercise apparatus according to claim 1, wherein said right and left pivot arms pivot to a collapsed position in which all portions of the exercise apparatus are within six inches of the floor surface.

5. An exercise apparatus according to claim 1, wherein tightening of said knob relative to said bolt increases the frictional resistance, and loosening of said knob relative to said bolt decreases the frictional resistance.

6. An exercise apparatus according to claim 1, wherein each of said pivot arms includes an upper segment and a lower segment releasably fastened relative to one another, and each of said pivot arms is longer than said base, but each lower segment is shorter than said base and falls within the planform of said base when pivoted to a storage position.

* * * * *